United States Patent [19]

Marchesini

[11] 4,278,384

[45] Jul. 14, 1981

[54] APPARATUS FOR SEVERING PACKAGES CONTAINING GRANULAR OR POWDER-LIKE MATTER AND SEVERING THE MATTER THEREFROM

[75] Inventor: Wainer Marchesini, Carpi, Italy

[73] Assignee: WAM dei Fratelli Marchesini s.n.c., Modena, Italy

[21] Appl. No.: 60,405

[22] Filed: Jul. 24, 1979

[30] Foreign Application Priority Data

Jan. 10, 1979 [IT] Italy ..... 28903/79[U]

[51] Int. Cl.[3] ..... B65B 69/00

[52] U.S. Cl. ..... 414/412; 209/247; 209/284; 209/297

[58] Field of Search ..... 209/241, 247, 284, 288, 209/293, 294, 297, 298, 3, 261; 414/412

[56] References Cited

U.S. PATENT DOCUMENTS

| | | | |
|---|---|---|---|
| 2,711,824 | 6/1955 | Ehrler | 209/298 |
| 3,386,602 | 6/1968 | Kanarek | 209/298 X |
| 3,394,808 | 7/1968 | Thompson | 209/247 X |
| 4,182,592 | 1/1980 | Henryson | 414/412 |

*Primary Examiner*—William A. Cuchlinski, Jr.

[57] ABSTRACT

Apparatus is disclosed for severing severable wrappers or packages containing granular or powder-like matter and for separating the matter from the severable packages. The apparatus comprises a helical screw, made of band-shaped foil wound helicoidally around a shaft, which rotates within a channel equipped with an open top load end where the packages to be torn are placed. The helical screw conveys both severed packages as well as the matter to a separating apparatus comprised of a rotatable housing made of screening and placed adjacent thereto to effect complete separation.

2 Claims, 2 Drawing Figures

APPARATUS FOR SEVERING PACKAGES CONTAINING GRANULAR OR POWDER-LIKE MATTER AND SEVERING THE MATTER THEREFROM

The subject of this invention relates to severing and separating apparatus designed especially for expendable or severable packages or wrappings containing granular or powder-like matter.

It is specifically but not exclusively, employed to advantage in activities or processes in which provision is made for considerable quantities of granular, powder-like or semi-fluid materials or products, packed in expendable packages or wrappings. Many of the materials used, for example in the building industry, such as cement, lime, etc., are normally packed in sturdy paper bags are opened at the moment of employment and thereafter disposed.

Usually, opening of the packages or wrappings is done manually. In case of big quantities this requires the use of a considerable amount of labour.

Moreover, it frequently happens that these packages contain toxic products of others the handling of which is dangerous, and adequate measures for the protection of the health of the persons dealing with their manipulation must necessarily be adopted. The object of this invention is to provide a a severing and separating apparatus which permits the opening of bags or wrappings which contain materials or products in granular, powder-like or semifluid form and which effects simply and rapidly the complete separation of these materials from their packages. An object of this invention is to remove matter from its package economically, i.e., with a minimum of labor.

A further object of this invention is its ease of installation. These and other objects of this invention are met in accordance with the teachings of this invention by providing apparatus comprising suitable means for tearing the packages or wrappings containing granular, powder-like or semi-fluid matter and conveying together the packages or wrappings and materials to an adjacent screening equipment designed to effect their complete separation.

Further characteristics and advantages of this invention will appear more clearly in the following description of a preferred, but not exclusive embodiment, illustrated in the enclosed drawings as a non-limiting example only:

Figure 1:
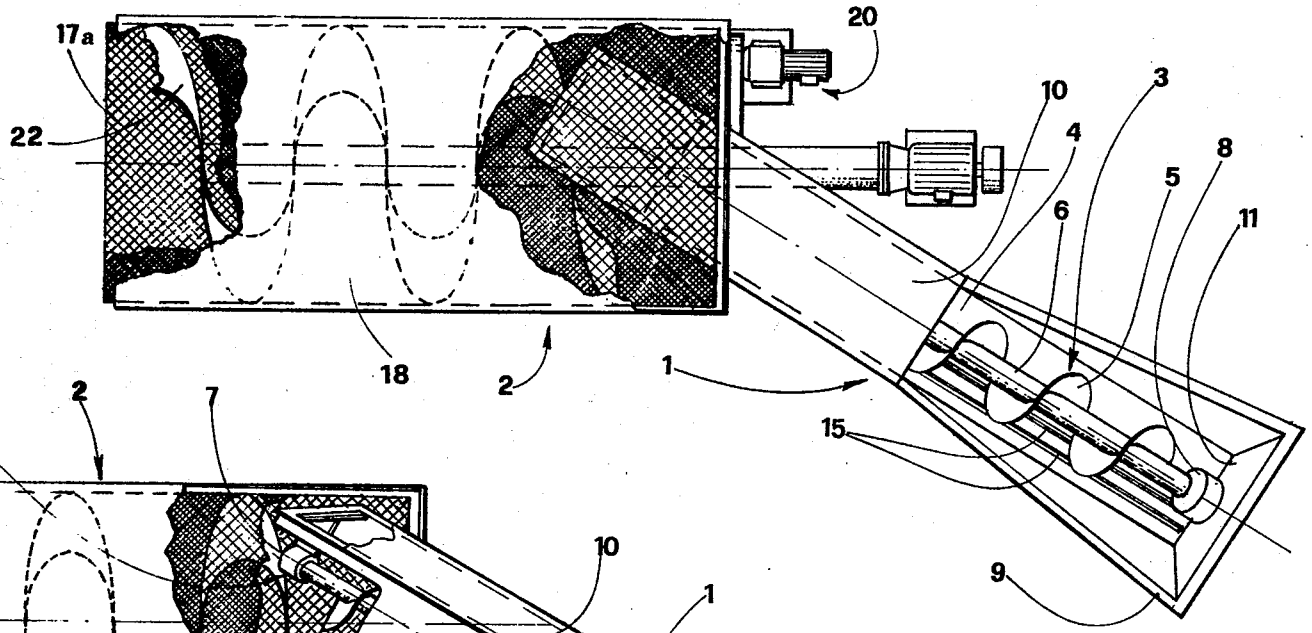
FIG. 1 shows a partially sectioned plan view.
Figure 2:
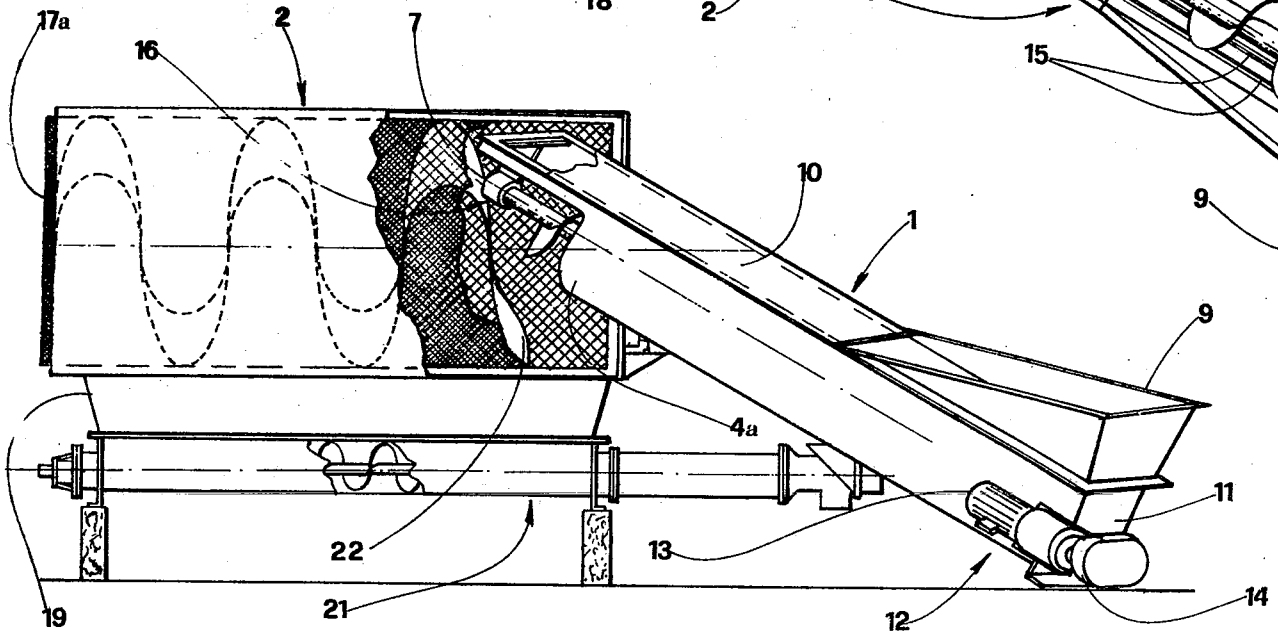
FIG. 2 shows a partially sectioned vertically elevated side view of FIG. 1.

With reference to the above mentioned figures, numeral (1) designates apparatus for severing packages or wrappings containing refined granular or powder-like matter and for conveying the empty packages or wrappings together with the matter to a screening equipment (2) designed to effect complete separation.

The apparatus (1) includes a cylindric (or conical) helical screw (3), revolving around its own axis disposed coaxially within a channel (4) having an approximate U-shaped section.

The screw (3) is made of band-shaped foil (5) and bent and wound helicoidally around a shaft (6) to which it is firmly secured.

The shaft (6) is supported, in correspondence to both ends of the channel (4) by means of two bearings (7) and (8) which allow the shaft (6) free rotation around its own axis.

The channel (4) is sloping and has a loading end, below, open on top and equipped with a load- feed box (9).

The remaining length of the channel (4) is closed on top by a plane foil (10) and terminates with one free dumping end (16), at which the bearing (7) of the end of the screw (3) is placed.

The end of the screw (3) extends past in part the surface of the wall (4*a*) which limits the channel below and side-wise. The bearing (8) is firmly connected to one wall (11) which closes the channel (4) at its loading end. On the outside of the wall (11) an assembly (12) for the production and transmission of the motion of the screw (3) is placed, which includes an electric motor (13) with connected reduction gear (14).

Within the channel (4), protruding foils are placed lengthwise (15) whose function is to prevent the winding of the bags and wrappings around the screw (3) and facilitate their conveyance along the channel (4). The direction of rotation of the screw (3) is such as to convey the packages and materials from its loading to its unloading end. The dumping end (16) is inserted into the cylindrically shaped, screening equipment (2), which rotates on an horizontal axis (17) and is open at both ends. The bottom of the screening equipment (2) is connected with a salvage feed box (19) which extends for almost the full length of the screening equipment (2). The cylindrical screening equipment (2) is enclosed, above and alongside, by a cylindrical external housing (18). Everything passing the mesh is expelled at the open end (17*a*) of the screening equipment (2) which is rotated by a motor-reduction assembly (20).

A coaxial propeller (22) is disposed within the screening equipment for conveying to the open end (17*a*), in accordance with the direction of rotation of the screen, the bags or empty wrappings, separated from those materials which they contained originally.

The propeller (22) is made of band-shaped foil, bent and wound coaxially propeller-like onto the inside surface of the screen (17) to which it is firmly secured thereto by welding.

In a different embodiment the screening equipment (2) may have a truncated conical shape disposed about a horizontal axis.

The feed box (9) causes the granular or powder-like matter to pass through the screening mesh (17) and to flow toward a screw conveyer (21) which carries it to the point of utilization. The device under discussion works as indicated below. The bags which are to be opened are introduced either manually or mechanically into the feed box (9) at the loading end of the channel (4), whose inclination is adjustable.

The screw (3), is rotated by the assembly (12), to cut the single packages into several pieces by penetrating the with the outside edge of their foil (5) and to carry them along, partially, with its own movement.

The projecting foils (15) which are placed lengthwise, inside the channel (4), prevent winding of the packages (or wrappings) around the screw (3) and facilitate the movement of the packages along the channel.

The packages (or wrappings) which are open, are brought out together with the granular or powder-like matter at the free dumping end (16) of the channel (4) and are collected at the bottom of the screening equipment (2).

The matter in granular or powder-like form passes the screen (17) thus converging through the salvage feed box (19).

The packages (or wrappings) which are empty, remain on the internal surface of the screen and are disposed of through of the open end (17*a*) and are conveyed toward same by the propeller (22).

Numerous changes may be made in the above-described apparatus and different embodiments of the invention may be made without departing from the spirit thereof; therefore, it is intended that all matter contained in the foregoing description and the accompanying drawings shall be interpreted as illustrative and not in a limiting sense.

I claim:

1. Apparatus for removing and separating granular or powder-like matter from severable packages, said apparatus mounted on a support surface, said apparatus comprising:

(a) conveyor means including a channel supported at an incline with respect to the support surface and having inlet means disposed at a relatively low position with respect to the support surface and an outlet means disposed at a relatively high position with respect to the support surface, a conveyor screw rotatively mounted within said channel and having an edge, motor means coupled to said conveyor screw for rotating said conveyor screw whereby packages disposed within said inlet means are severed and the severed packages and their matter are conveyed by said conveyor screw to said outlet means and wherein there is included a plurality of foils disposed longitudinally along the length of said channel and spaced from each other for coacting with said edge of said conveyor screw for preventing the severed packages from winding themselves about said conveyor screw and for facilitating the conveyance of the severed packages from said inlet means to said outlet means; and (b) means disposed at said outlet means for receiving and separating the matter from the severed packages and including a housing having a plurality of matter discharge openings therein, each of said matter discharge openings being of a size large enough to enable the matter removed from the packages to pass from said housing but small enough to prevent the empty packages from passing therethrough, an enlarged exit opening and means disposed within said housing for removing the empty packages from said housing and through said exit opening, while permitting the matter to pass through said plurality of said matter discharge openings.

2. Apparatus as claimed in claim 1, wherein said channel includes an inner peripheral surface and each of said plurality of foils is mounted on said inner peripheral surface to project toward said conveyor screw.

* * * * *